US009915437B2

(12) United States Patent
Aynur et al.

(10) Patent No.: US 9,915,437 B2
(45) Date of Patent: Mar. 13, 2018

(54) FORCED CONVECTION HEAT EXCHANGER FOR A REFRIGERATION APPLIANCE

(71) Applicant: ARCELIK ANONIM SIRKETI, Istanbul (TR)

(72) Inventors: Tolga Nurettin Aynur, Istanbul (TR); Tolga Apaydin, Istanbul (TR); Vasi Kadir Ertis, Istanbul (TR); Husnu Kerpicci, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 31 days.

(21) Appl. No.: 15/026,180

(22) PCT Filed: Sep. 30, 2013

(86) PCT No.: PCT/EP2013/070354
§ 371 (c)(1),
(2) Date: Mar. 30, 2016

(87) PCT Pub. No.: WO2015/043676
PCT Pub. Date: Apr. 2, 2015

(65) Prior Publication Data

US 2016/0238262 A1 Aug. 18, 2016

(51) Int. Cl.
*F28D 1/047* (2006.01)
*F24F 1/00* (2011.01)
(Continued)

(52) U.S. Cl.
CPC ..... *F24F 1/0059* (2013.01); *F24F 1/14* (2013.01); *F24F 1/38* (2013.01); *F25B 39/04* (2013.01);
(Continued)

(58) Field of Classification Search
CPC ..... F28D 1/047; F28D 1/0478; F28F 1/126; F28F 9/0132; F25B 39/04; F25B 2339/04;
(Continued)

(56) References Cited

U.S. PATENT DOCUMENTS 1,704,409 A * 3/1929 Scott ..... F28D 1/0477 165/122
1,788,068 A * 1/1931 Scott ..... F28F 1/32 165/149
(Continued)

FOREIGN PATENT DOCUMENTS

DE 102011007415 A1 10/2012
JP S62142682 U 9/1987
(Continued)

OTHER PUBLICATIONS

WO2013059193A1 Machine Translation English—Retrieved Jun. 2017.*
(Continued)

*Primary Examiner* — Len Tran
*Assistant Examiner* — Jenna M Hopkins
(74) *Attorney, Agent, or Firm* — Kilpatrick Townsend & Stockton LLP

(57) ABSTRACT

The present invention relates to a refrigeration appliance having a compressor for effecting the refrigeration cycle, a heat exchanger (1) for condensing the refrigerant fluid through refrigerant flow tubes (2) in serpentine form where the refrigerant flow is provided, said heat exchanger (1) being disposed against a fan (3) that is structurally integrally provided to effect forced heat convection for cooling said heat exchanger (1) by blowing air thereon.

12 Claims, 7 Drawing Sheets

Figure 1:
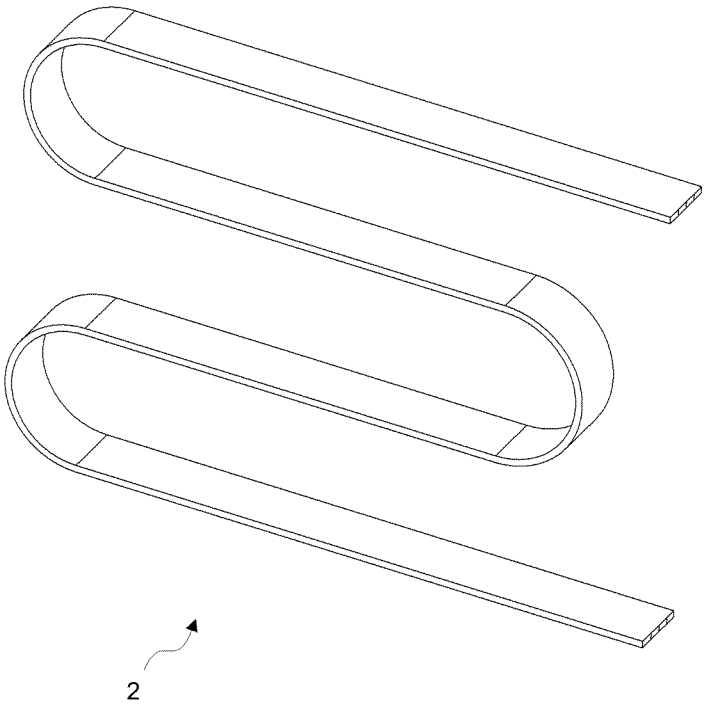

(51) Int. Cl.

| | |
|---|---|
| ***F28F 9/013*** | (2006.01) |
| ***F24F 1/14*** | (2011.01) |
| ***F24F 1/38*** | (2011.01) |
| ***F28F 1/12*** | (2006.01) |
| ***F28D 1/02*** | (2006.01) |
| ***F25B 39/04*** | (2006.01) |
| *F24F 1/18* | (2011.01) |
| *F24F 1/16* | (2011.01) |
| *F24F 1/56* | (2011.01) |
| *F28D 21/00* | (2006.01) |

(52) U.S. Cl.
CPC ..... *F28D 1/024* (2013.01); *F28D 1/047* (2013.01); *F28D 1/0478* (2013.01); *F28F 1/12* (2013.01); *F28F 1/126* (2013.01); *F28F 9/0132* (2013.01); *F24F 1/16* (2013.01); *F24F 1/18* (2013.01); *F24F 1/56* (2013.01); *F25B 2339/04* (2013.01); *F28D 2021/007* (2013.01); *F28F 2260/02* (2013.01); *F28F 2275/08* (2013.01)

(58) Field of Classification Search
CPC ..... F24F 1/16; F24F 1/18; F24F 1/38; F24F 1/56
See application file for complete search history.

(56) References Cited

U.S. PATENT DOCUMENTS

| | | | | |
|---|---|---|---|---|
| 5,289,872 | A * | 3/1994 | Kent | F28D 1/0478 165/133 |
| 5,660,050 | A * | 8/1997 | Wilson | F25B 39/04 165/110 |
| 5,725,047 | A * | 3/1998 | Lopez | F28D 7/08 165/149 |
| 6,286,325 | B1 | 9/2001 | Chiu et al. | |
| 7,281,287 | B2 * | 10/2007 | Shimazaki | E01D 19/02 14/14 |
| 7,281,387 | B2 * | 10/2007 | Daddis, Jr. | A47F 3/0408 165/110 |
| 2002/0083732 | A1 * | 7/2002 | Incorvia | F25B 39/04 62/474 |
| 2003/0213259 | A1 * | 11/2003 | Upton | A47F 3/0408 62/246 |
| 2004/0182553 | A1 * | 9/2004 | Seno | F25B 39/04 165/132 |
| 2006/0090878 | A1 * | 5/2006 | Levasseur | F28D 1/0435 165/67 |
| 2006/0144076 | A1 * | 7/2006 | Daddis, Jr. | A47F 3/0408 62/440 |
| 2007/0023170 | A1 * | 2/2007 | Blersch | F25B 39/04 165/152 |
| 2009/0211733 | A1 * | 8/2009 | Tranier | F25J 3/04412 165/104.21 |
| 2010/0012307 | A1 * | 1/2010 | Taras | F28D 1/0471 165/177 |
| 2011/0174013 | A1 * | 7/2011 | Moraes | F24F 1/16 62/498 |
| 2011/0272120 | A1 * | 11/2011 | Joshi | F28D 1/0426 165/104.13 |
| 2012/0011867 | A1 * | 1/2012 | Koons | F25B 39/04 62/115 |
| 2012/0267088 | A1 * | 10/2012 | Lange | F28D 15/0275 165/181 |
| 2013/0292098 | A1 * | 11/2013 | Jindou | F28F 13/06 165/143 |
| 2013/0340451 | A1 * | 12/2013 | Sapp | F25B 39/04 62/115 |

FOREIGN PATENT DOCUMENTS

| | | | | |
|---|---|---|---|---|
| JP | H02290673 | A | 11/1990 | |
| JP | 2011145023 | A * | 7/2011 | |
| JP | 2011145024 | A * | 7/2011 | |
| KR | 101053172 | B1 | 8/2011 | |
| WO | WO 2012172928 | A1 * | 12/2012 | F28D 1/0478 |
| WO | WO 2013059193 | A1 * | 4/2013 | C22C 21/02 |

OTHER PUBLICATIONS

WO2012172928A1 Machine Translation English—Retrieved Jun. 2017.*
15026180 STIC Search Results—Retrieved Jun. 2017.*
JP20130059284 Machine Translation English (Corresponds to WO2013059193 A1 as English Translation)—Retrieved Jun. 2017.*
A Roadmap for Implementing Minichannel in Refrigeration and AC Systems by S.G. Kandlikar 2007—Retrieved Jun. 2017.*
JP2011145023A Machine Translation English—Retrieved Jun. 2017.*
JP2013062900 Machine Translation English (Corresponds to WO2012172928 A1 as English Translation)—Retrieved Jun. 2017.*
International search report for PCT application No. PCT/EP2013/070354.
Written opinion of the international searching authority for PCT application No. PCT/EP2013/070354.

* cited by examiner

FORCED CONVECTION HEAT EXCHANGER FOR A REFRIGERATION APPLIANCE

The present invention relates to a heat exchanger having an improved thermal performance and more particularly the present invention relates to a heat exchanger structurally designed to enhance heat transfer performance.

It is well-known that in the refrigerant cycle effected in refrigeration appliances, the thermal energy absorbed from the inner cabin of the appliance is discharged to the surrounding room by means of a condenser. The refrigerant fluid is accordingly circulated between a condenser, an expansion device such as a capillary tube and an evaporator. The refrigerant fluid undergoes a phase change from the liquid phase into the gas phase by way of absorbing the ambient heat of the foodstuff preserved within the cabin while passing through the evaporator. Subsequently, the pressurized refrigerant fluid releases its heat on the condenser surface.

A condenser may be a static one that is operable by natural heat convection or a forced heat convection method can alternatively be adapted. The machine room of the refrigeration cabinet in a refrigeration appliance may accommodate the compressor and a fan to fulfill the forced heat convection operation. Heat transfer from the condenser to the outer environment can hence be accomplished in a pretty efficient manner such that removal of the heat by enforced convection is provided via a fan blowing air over the condenser.

Among others, a prior art patent publication relevant to the technical field of the present invention can be referred to as JP2011145023A, disclosing a heat exchanger with a plurality of linearly-extending heat transfer tubes held by fixing members in parallel with each other. The heat transfer tubes having flat-shaped cross sections are fixed to be spaced at predetermined intervals. Flat plate-like fins are provided with the insertion grooves inserted with the heat transfer tubes and a plurality of the heat transfer tubes fixed by the fixing members are assembled by press-fitting the heat transfer tubes to said insertion grooves.

The present invention, on the other hand, proposes a heat exchanger structure comprising a plurality of mechanical components assembled without thermal treatment while structural integrity is maintained so as to withstand any internal and external forces, at the same time enhancing heat exchange capacity as provided by the characterizing features defined in Claim 1.

Primary object of the present invention is to provide a heat exchanger assembled without thermal treatment and having an enhanced heat exchange capacity due to its mechanical components while at the same time withstanding any internal and external forces so as to maintain its structural integrity.

The present invention proposes a heat exchanger having two upright elements standing on the interior base of a refrigeration compartment and carrying and supporting refrigerant flow tubes such that linear arms of the tubes are secured to a plurality of mounting slits provided on the upright element. Further, accordion-like fins are secured into rectangular openings formed by two lateral upright elements and two linear arms of the refrigerant flow tubes above and below. The accordion-like fins are placed in compressed form and in contact therewith so as to provide and enhance thermal communication.

The accordion-like fins are formed by folding thin plate-like metal sheet parts to obtain a longitudinal zigzag shape spring-like accordion structure. The serpentine-form refrigerant flow tubes are structured to incorporate four parallel arms one above the other in an equally-spaced manner. Each arm in the uppermost two arms (the first pair of parallel arms) and in the lowermost two (the last pair of parallel arms) are connected by U-turns provided at a first side. The second and the third arms, i.e. the two arms in the middle are connected by a U-turn juncture at the other side.

The upright elements' base portions have base fixation recesses attachable to base extensions on the interior base of the refrigeration appliance to securely hold the heat exchanger in upright position.

A plurality of fixing clips keeps the accordion-like fins fixed in the rectangular openings at the two ends thereof at a first face of the heat exchanger. A fan housing is mounted on the other face of the heat exchanger. The housing comprises integral fixing clips having the same function of joining two ends of an accordion-like fin to the two lateral upright elements at the other face of the structure formed by the serpentine-form flow tubes and upright elements.

Accompanying drawings are given solely for the purpose of exemplifying a heat exchanger whose advantages over prior art were outlined above and will be explained in brief hereinafter.

The drawings are not meant to delimit the scope of protection as identified in the claims nor should they be referred to alone in an effort to interpret the scope identified in said claims without recourse to the technical disclosure in the description of the present invention.

FIG. 1 demonstrates a general perspective view of serpentine-form mini-channel structure refrigerant flow tubes according to the present invention.

Figure 2:
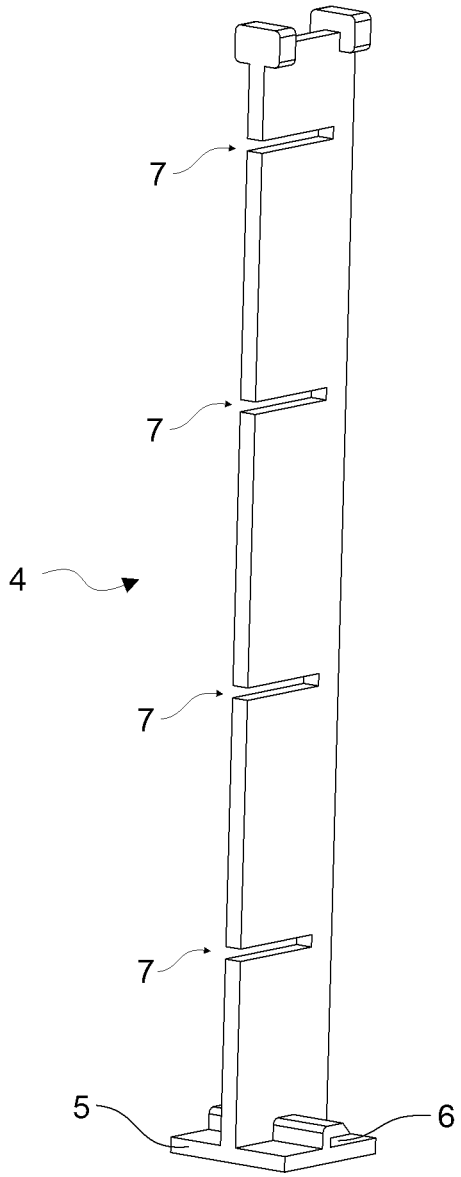

FIG. 2 demonstrates a general perspective view of an upright element for carrying and supporting the serpentine-form fluidic channels according to the present invention.

Figure 3:
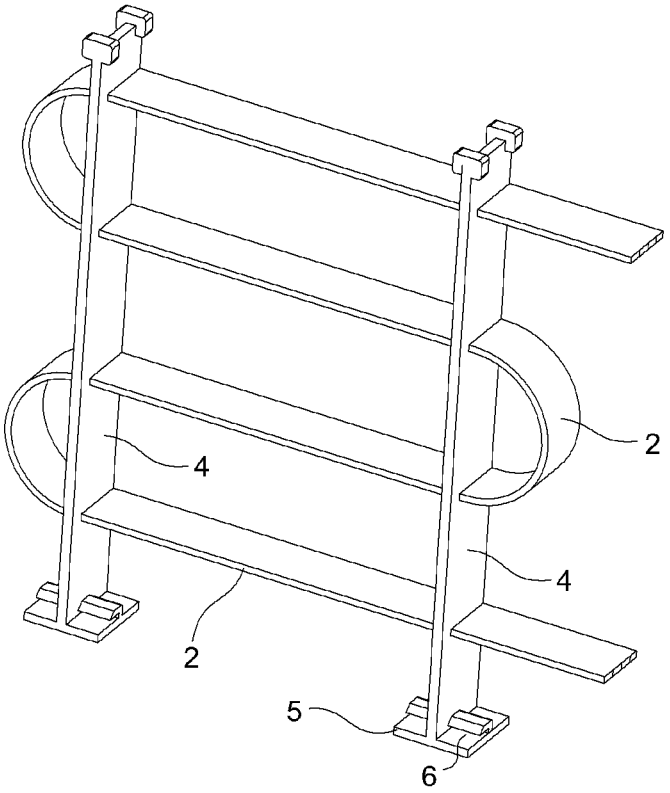

FIG. 3 demonstrates a general perspective view of serpentine-form mini-channel structure refrigerant flow tubes as carried by two upright elements according to the present invention.

Figure 4:
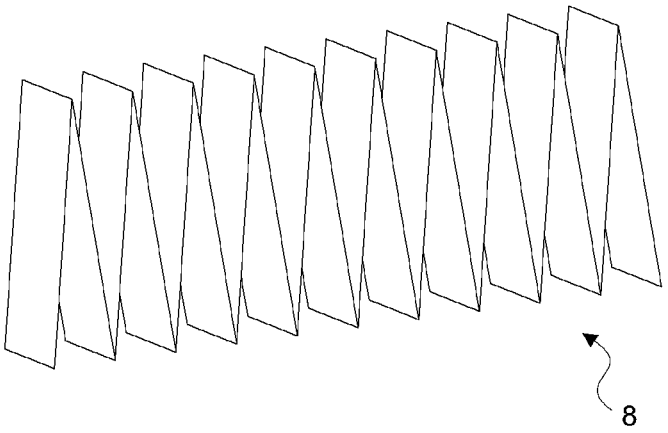

FIG. 4 demonstrates a general perspective view of the accordion-like fins according to the present invention.

Figure 5:
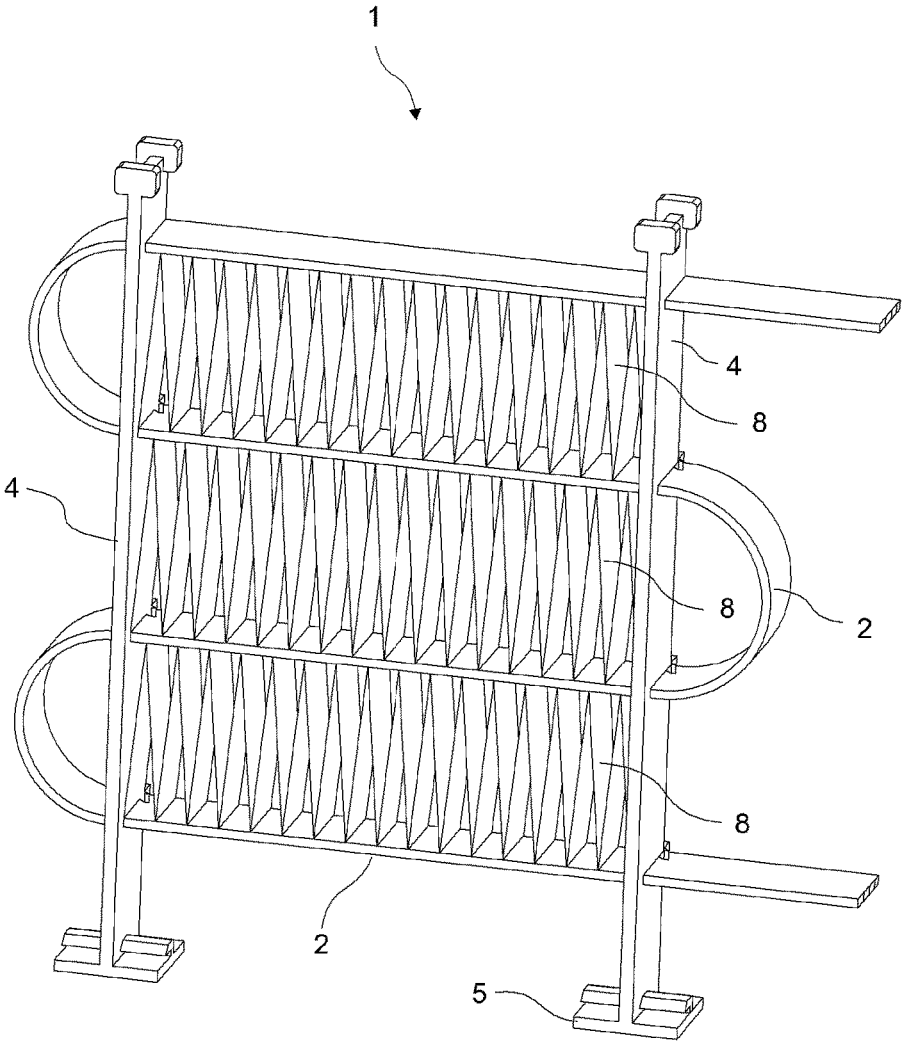

FIG. 5 demonstrates a general view of a heat exchanger, wherein the accordion-like fin compressed to fit into a rectangular opening delimited by two opposite upright elements at both sides and by two sections of the serpentine-form refrigerant flow tubes from above and below according to the present invention.

Figure 6:
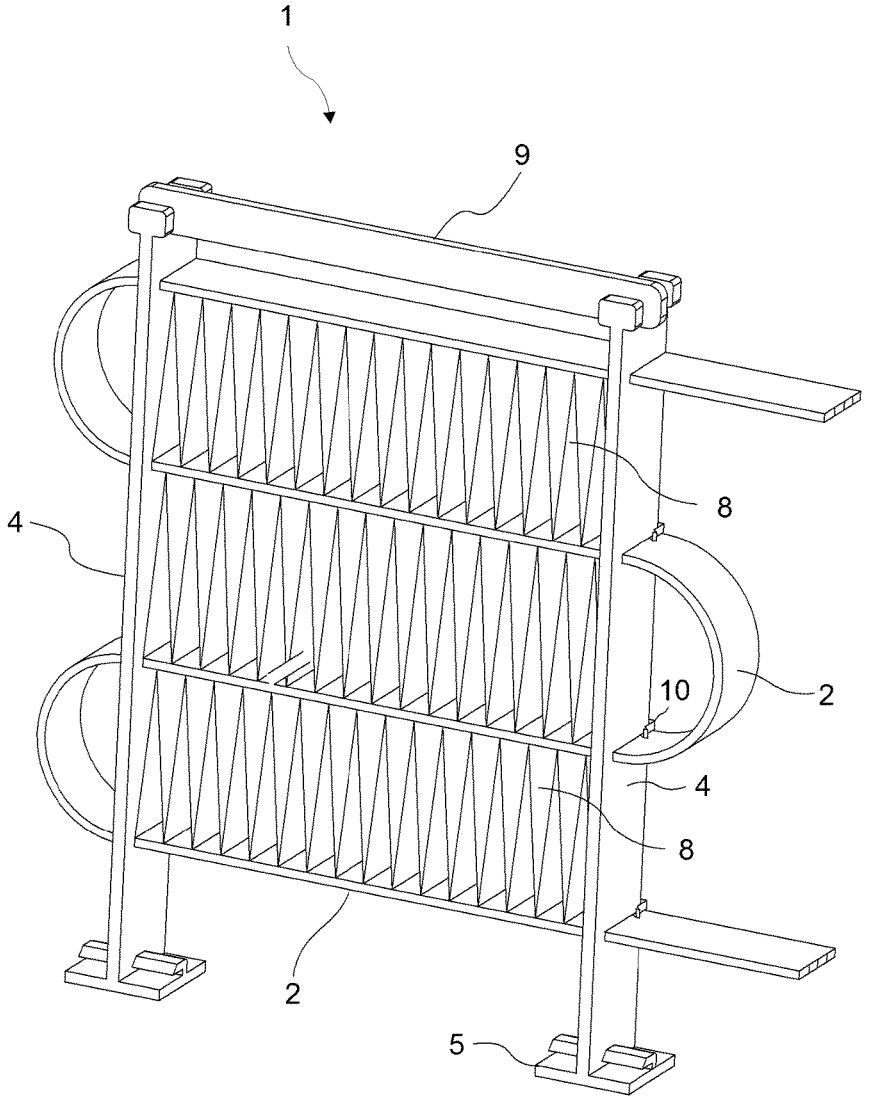

FIG. 6 demonstrates the heat exchanger of FIG. 5 with an upper fixation means according to the present invention.

Figure 7:
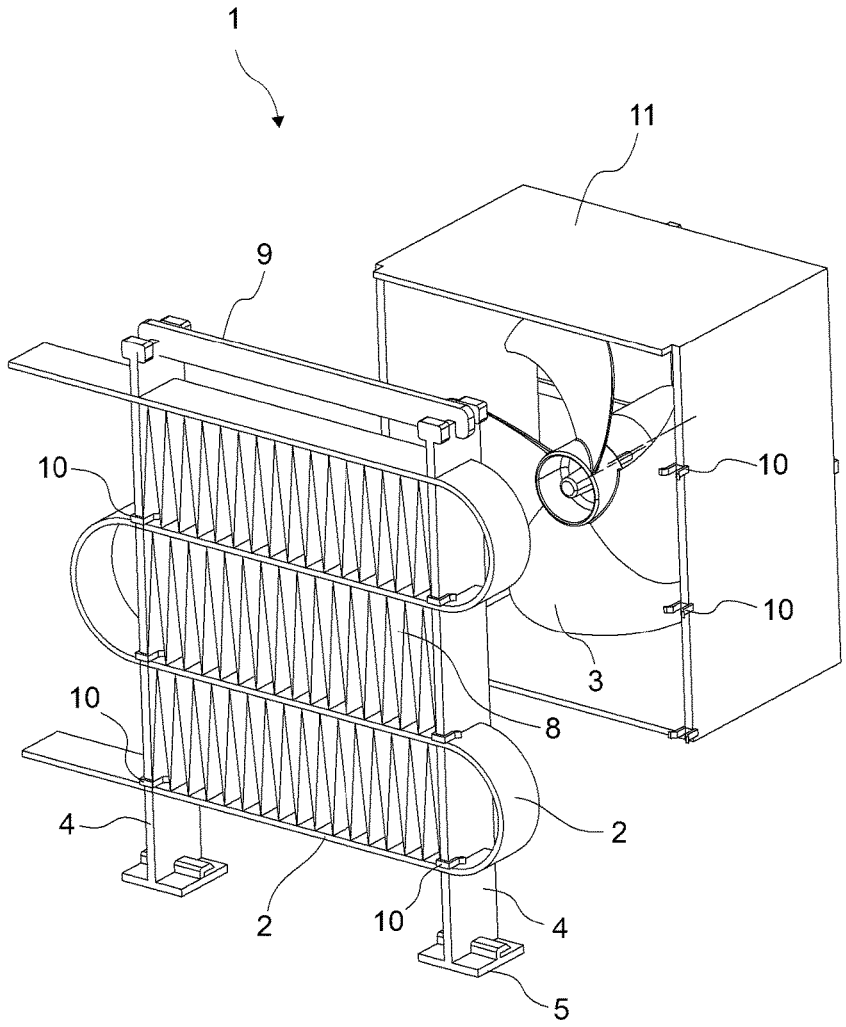

FIG. 7 demonstrates the heat exchanger of FIG. 6 before assembling the fan housing according to the present invention.

Figure 8:
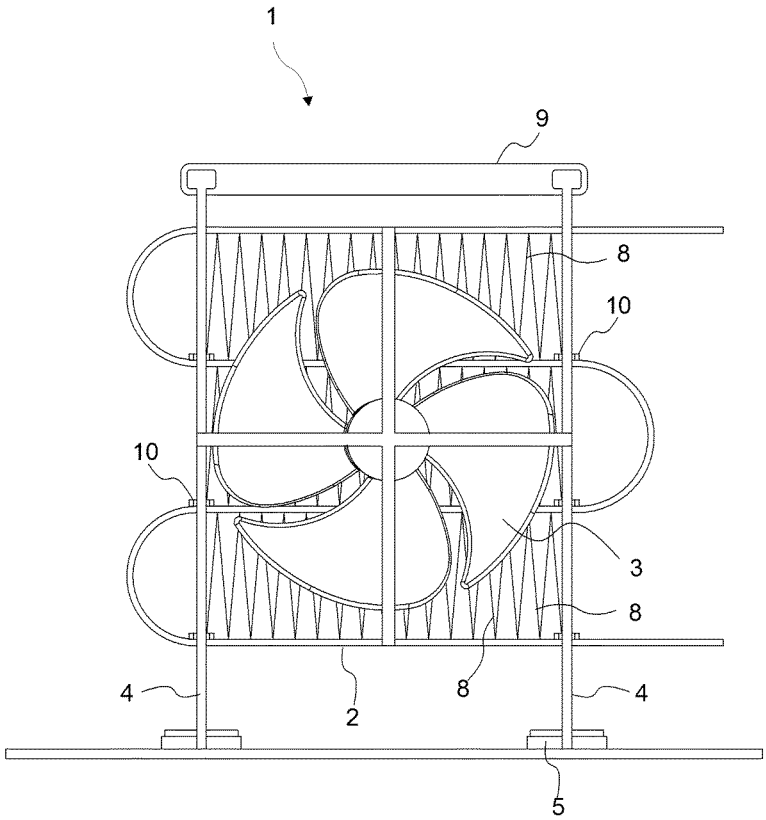

FIG. 8 demonstrates a front view of the assembled heat exchanger according to the present invention.

The following numerals are used in the detailed description:

1. Heat exchanger
2. Refrigerant flow tube
3. Fan
4. Upright element
5. Base portion
6. Base fixation recess
7. Mounting slit
8. Accordion-like fin
9. Locking means
10. Fixing clip
11. Fan housing The present invention proposes a heat exchanger (1), for instance for a household cooling appliance such as a refrigerator, said heat exchanger (1) having a refrigerant flow tube (2) in mini-channel structure and in serpentine form. These refrigerant flow tube (2) typically serve to the purpose of circulating the refrigerant fluid pressurized by a compressor such that thermal energy is dissipated by the heat exchanger, i.e. the condenser of the household appliance. Additionally, a fan (3) is structurally integrally provided to effect forced heat convection.

The present invention therefore proposes a heat exchanger (1) for condensing a refrigerant fluid through refrigerant flow tube (2) in serpentine form where the refrigerant flow is provided, said heat exchanger (1) being disposed against a fan (3) that is structurally integrally provided to effect forced heat convection for cooling said refrigerant flow tube (2) of the heat exchanger (1) by blowing air thereon.

According to the present invention, the heat exchanger (1) comprises two upright elements (4) provided to carry and support said refrigerant flow tube (2) such that the linear arms thereof are fitted into mounting slits (7) on each upright element (4). In this way, the linear arms of the refrigerant flow tube (2) are maintained in an orientation parallel to the ground and perpendicular to the longitudinal axes of said upright elements (4).

FIG. 3 demonstrates a general perspective view of serpentine-form mini-channel structure refrigerant flow tube (2) as carried by two upright elements (4) according to the present invention. An accordion-like fin (8) is compressed to fit into a rectangular opening delimited by two opposite upright elements (4) at both sides and by two arms of the serpentine-form refrigerant flow tube (2) from above and below to be in contact therewith. Flexure forces on the lateral inner surfaces of the upright elements (4) exerted by said accordion-like fins (8) are structurally balanced by a locking means (9) secured to the upper parts of the two upright elements (4).

According to an embodiment of the present invention, the serpentine-form refrigerant flow tube (2) is structured to incorporate four parallel arms in a manner equally-spaced one above the other such that the uppermost two and the lowermost two are connected in themselves by U-turns provided at a first side and the second and the third arms being connected by a U-turn juncture at the other side.

In an embodiment of the invention, three separate rectangular opening are accordingly formed by four linear arms of the serpentine-form mini-channel structure refrigerant flow tube (2) and three accordion-like fins (8) are therefore secured into these openings.

In an embodiment of the present invention, said upright elements' (4) base portions (5) are provided with base fixation recesses (6) suitable for interengaging with extensions provided on the interior base of the refrigeration cabin of the refrigeration appliance. Said upright elements (4) are therefore securely held in position and fixedly attached to the cabin base.

According to another embodiment of the invention, the accordion-like fins (8) are thin plate-like metal sheet parts shaped to extend longitudinally in zigzag form to obtain a spring-like accordion structure. To this end, an accordion-like fin (8) compressed to fit into a rectangular opening exerts lateral forces to the upright elements (4) at both sides of the heat exchanger (1) structure. The compressed structure is advantageous in that an increased number of individual, folded sheet parts are present in an accordion-like fin (8), therefore enhancing thermal exchange capacity.

According to the present invention, thermal exchange capacity being enhanced by the compressed form of the accordion-like fin (8) so as to apply flexure forces on the lateral inner surfaces of the upright elements (4) is structurally balanced by the locking means (9) secured to the upper parts of the two upright elements (4) so as to keep the distance thereinbetween constant and avoid the same moving away from each other.

In another embodiment of the present invention, a plurality of fixing clips (10) are provided to keep the accordion-like fins (8) fixed in the rectangular openings by way of clipping an outermost sheet part of an accordion-like fin (8) and a neighboring upright element (4) together. In this way, each accordion-like fin (8) is fixedly attached to the two upright elements (4) at both lateral sides at a first face of the heat exchanger (1).

In a further embodiment of the present invention, the other face of the heat exchanger (1) receives a fan housing (11), the latter functional in guiding airflow generated by the fan (3) to the serpentine-form fluidic channels and surrounding parts such that the air blown by the fan (3) in the axial direction acts thereon.

In a still further embodiment of the present invention, the fan housing (11) of the invention is formed to incorporate integral clipping means or fixing clips (10) having the same function as the individual fixing clips (10) joining a respective accordion-like fin (8) to the two lateral upright elements (4). Said accordion-like fins (8) may also be formed of leaves alternately hinged at opposite margins.

The compressed structure of the accordion-like fins (8) is advantageous in that an increased number of individual, folded sheet parts are present in an accordion-like fin (8), therefore enhancing thermal exchange capacity. Flexure forces on the lateral inner surfaces of the upright elements (4) is structurally balanced by the locking means (9) secured to the upper parts of the two upright elements (4). Therefore, a heat exchanger assembled without thermal treatment and having an enhanced heat exchange capacity due to its mechanical components while at the same time withstanding any internal and external forces so as to maintain its structural integrity is provided.

The invention claimed is:

1. A heat exchanger (1) for a refrigeration appliance and condensing a refrigerant fluid through refrigerant flow tube (2) in mini-channel structure and in serpentine form where the refrigerant flow is provided, said heat exchanger (1) being disposed against a fan (3) structurally integrally provided to effect forced heat convection for cooling said refrigerant flow tube (2) by blowing air thereon, characterized in that—two upright elements (4) are vertically oriented and are provided to carry and support said refrigerant flow tubes (2) such that linear arms of the refrigerant flow tube thereof are fitted into parallel mounting slits (7) along a length of each upright element (4), each mounting slit comprising an open end that faces horizontally outward and is configured to receive a portion of the linear arm of the refrigerant flow tube (2), and a closed end, —accordion-like fins (8) in compressed form are provided to fit into rectangular openings delimited by two opposite upright elements (4) at both sides and by two arms of the serpentine-form refrigerant flow tubes (2) from above and below in contact therewith, —a locking device (9) secured to upper parts of the two vertically oriented upright elements (4) so as to keep the distance thereinbetween constant and avoid the same moving away from each other, and further comprising a plurality of fixing clips (10) that are provided to keep the accordion-like fins (8) fixed in the rectangular openings by way of clipping an outermost folded sheet part of an accordion-like fin (8) and a neighboring upright element (4) together such that each accordion-like fin (8) is fixedly attached to the two upright elements (4) at both lateral sides at a first face of the heat exchanger (1).

2. A heat exchanger (1) as in claim 1, characterized in that said accordion-like fins (8) are substantially thin plate-like metal sheet parts shaped to extend longitudinally in zigzag form to exhibit a spring-like accordion structure.

3. A heat exchanger (1) as in claim 1, characterized in that said linear arms of the refrigerant flow tubes (2) are maintained in an orientation parallel to the ground and perpendicular to the longitudinal axes of said upright elements (4).

4. A heat exchanger (1) as in claim 1, characterized in that said serpentine-form refrigerant flow tubes (2) are structured to incorporate four parallel arms in a manner equally-spaced such that the first pair of parallel arms and the last pair of parallel arms are connected in themselves by U-turns provided at a first side and the second and the third arms being connected by a U-turn juncture at the other side.

5. A heat exchanger (1) as in claim 1, characterized in that said upright elements' (4) base portions (5) are provided with base fixation recesses (6) interengageable with extensions provided on an interior base portion of a refrigeration appliance such that the upright elements (4) can be securely held in position and fixedly attached to a refrigeration appliance's interior base.

6. A heat exchanger (1) as in claim 1, characterized in that three separate rectangular openings are formed by four linear arms of the serpentine-form mini-channel structure refrigerant flow tubes (2) and three accordion-like fins (8) are secured into said rectangular openings.

7. A heat exchanger (1) as in claim 6, characterized in that the other face of the heat exchanger (1) receives a fan housing (11) functional in guiding airflow generated by said fan (3) to the serpentine-form fluidic refrigerant flow tubes (2), said fan housing (11) being formed to incorporate integral fixing clips (10) having the function of joining two ends of an accordion-like fin (8) to the two lateral upright elements (4).

8. A heat exchanger (1) as in claim 2, characterized in that said linear arms of the refrigerant flow tubes (2) are maintained in an orientation parallel to the ground and perpendicular to the longitudinal axes of said upright elements (4).

9. A heat exchanger (1) as in claim 8, characterized in that said serpentine-form refrigerant flow tubes (2) are structured to incorporate four parallel arms in a manner equally-spaced such that the first pair of parallel arms and the last pair of parallel arms are connected in themselves by U-turns provided at a first side and the second and the third arms being connected by a U-turn juncture at the other side.

10. A heat exchanger (1) as in claim 9, characterized in that said upright elements' (4) base portions (5) are provided with base fixation recesses (6) interengageable with extensions provided on an interior base portion of a refrigeration appliance such that the upright elements (4) can be securely held in position and fixedly attached to a refrigeration appliance's interior base.

11. A heat exchanger (1) as in claim 10, characterized in that three separate rectangular openings are formed by four linear arms of the serpentine-form mini-channel structure refrigerant flow tubes (2) and three accordion-like fins (8) are secured into said rectangular openings.

12. A heat exchanger (1) as in claim 10, characterized in that the other face of the heat exchanger (1) receives a fan housing (11) functional in guiding airflow generated by said fan (3) to the serpentine-form fluidic refrigerant flow tubes (2), said fan housing (11) being formed to incorporate integral fixing clips (10) having the function of joining two ends of an accordion-like fin (8) to the two lateral upright elements (4).

* * * * *